US005632286A

United States Patent [19]

Berger et al.

[11] Patent Number: 5,632,286

[45] Date of Patent: May 27, 1997

[54] CRIMPED ELEMENTS FOR CIGARETTES AND THE LIKE AND METHODS AND APPARATUS FOR MAKING SAME

[75] Inventors: Richard M. Berger, Midlothian; Robert G. Hemsworth, Glen Allen, both of Va.

[73] Assignee: American Filtrona Corporation, Richmond, Va.

[21] Appl. No.: 263,436

[22] Filed: Jun. 21, 1994

[51] Int. Cl.[6] ..... A24B 3/12

[52] U.S. Cl. ..... 131/33; 131/339; 131/340

[58] Field of Search ..... 131/339, 340; 493/39, 42, 43, 45; 428/33, 542.8

[56] References Cited

U.S. PATENT DOCUMENTS

| | | | |
|---|---|---|---|
| 3,826,177 | 7/1974 | Berger et al. | 131/336 |
| 4,085,663 | 4/1978 | Holden et al. | 131/336 |
| 4,570,649 | 2/1986 | Nichols et al. | 131/336 |
| 4,617,946 | 10/1986 | Keith | 131/331 |
| 4,807,647 | 2/1989 | Hayes | 131/336 |

*Primary Examiner*—Vincent Millin
*Assistant Examiner*—Charles W. Anderson
*Attorney, Agent, or Firm*—Jacobson, Price, Holman & Stern PLLC

[57] ABSTRACT

A method for forming successive spaced crimps in a tow of fibrous material by passing the tow along a path defined by an apparatus comprising a plurality of crimping wheels disposed around the path, each wheel including teeth having crimping surfaces and adjacent sealing surfaces which slide over one another during crimping to prevent material from being squeezed between the teeth thereby forming crimped sections with elongate edges which are substantially free of flashing connecting non-crimped sections. A second crimping step may be incorporated to form longitudinal grooves in alternate non-crimped sections. The rod-like member produced by these techniques may be overwrapped to provide pockets surrounding the crimped sections which may be filled with a smoke-modifying material, for example, activated charcoal particles. Discrete elements cut from the rod-like member may be used in cigarettes and the like such as in the production of filtered cigarettes.

56 Claims, 4 Drawing Sheets

CRIMPED ELEMENTS FOR CIGARETTES AND THE LIKE AND METHODS AND APPARATUS FOR MAKING SAME

BACKGROUND OF THE INVENTION

This invention relates to crimped elements of the kind that may be used in cigarettes and related products, for example as tobacco smoke filters. The invention further relates to methods and apparatus for the manufacture of such elements.

Continuous rod-like members, particularly those to be used as cigarette filters, are commonly formed from tows of fibrous filter material, for example, plasticized cellulose acetate, or may alternatively be formed from gathered plastic film or paper or other materials that can be formed by well-known techniques into air-pervious plugs with a multiplicity of intercommunicating interstices which define a tortuous path for smoke, or a mixture of smoke and air, passing therethrough. In the case of a tow, the filamentary material is processed by various means as the tow travels lengthwise, through a continuous processing line. Depending on whether the processed material is self-sustaining or not, it may be continuously wrapped and cut into discrete lengths which may be further subdivided to form individual elements for association with tobacco sections in the production of filtered cigarettes.

It is common in continuously processing polymeric materials such as cellulose acetate tow or the like to provide spaced, radially compressed or crimped, sections. It is well known in the art to form successive, longitudinally spaced, crimped sections in a travelling length of suck materials by the use of a crimping apparatus comprising, for example, one or more crimping wheels which rotate in the direction of travel of the material and which may have spaced teeth or lobes about their periphery which successively engage the material to squeeze and compress the same at spaced intervals along its length. A plurality of crimping wheels may be positioned around the path of travel of the material with the rotation of the wheels synchronized such that teeth from multiple wheels simultaneously engage the material from different sides. Thus, as respective sets of teeth from the wheels synchronously move into engagement with the material, the material is squeezed and compressed therebetween forming a crimped section of smaller or, at least different, cross-section. As the teeth move out of engagement with the material, the original cross-section of the material is maintained. When the next set of teeth engages the material a further crimped section is formed and so on.

Examples of known crimping wheel structures used in the manufacture of cigarette filter rods and the like are disclosed in U.S. Pat. Nos. 3,826,177 and 4,085,663, commonly assigned with the instant application. The disclosures of these patents are expressly incorporated herein in their entirety by reference.

In known crimping wheel structures using a plurality of wheels, there are small gaps between the edges of the respective wheels. Therefore, as the travelling crimpable material passes between the wheels, commonly in a heated state, it is crimped, and edge portions of the material may be squeezed through such gaps at the interface between juxtaposed crimping teeth, resulting in the formation of "flashing" or thin fins on the edges of the compressed or crimped sections of the finished product. Such flashing is, at best, unsightly and undesirable in most applications; yet, in some applications, any substantial flashing is totally unacceptable.

SUMMARY OF THE INVENTION

It is an object of the invention to provide a substantially "flashless" crimped polymeric rod and elements cut therefrom which may be used in cigarettes and related products such as cigars and pipes, and a method and apparatus for making products of this nature. Such elements have particular utility, especially when made from plasticized cellulose acetate tow and the like, as tobacco smoke filters when secured in end-to-end relationship with a tobacco section in the production of filtered cigarettes.

The rod-like members are continuously formed using conventional processing techniques, with unique crimping apparatus according to this invention, providing bulbous, full-diameter sections or plugs of air-pervious material alternating with relatively smaller, crimped connecting sections integrally interconnecting the bulbous sections, the crimped sections having elongate edges which are totally free, or at least substantially free, of flashing.

Another object of the invention is to provide a shaped element for use in cigarettes and the like formed from a rod-like member as defined above which has been cut substantially centrally of each bulbous section to form a "dumbbell" shaped element with large, uncrimped, air-pervious, end plugs interconnected by a substantially flashless crimped section.

Still a further object of this invention is the provision of shaped, flashless, elements as described which may be wrapped about their ends with a helical or cylindrical wrapping formed of paper or the like so that an annular space or pocket is defined between the crimped section and the surrounding wrapping. The bulbous end portions of the rod-like element may be slightly oversized in diameter, to be compressed in a well-known manner by a wrapping material when it is applied thereto to enhance the sealing effect of the wrapping which may be applied to the ends of the element with or without adhesive therebetween.

Depending on the ultimate use of such elements, the space or pocket formed between the ends and the wrapping may be filled with a smoke-modifying medium, for example, activated charcoal particles, in which case the absence of flashing on the crimped section improves the uniformity and general efficiency of the product when used as a tobacco smoke filter. Alternatively, the pocket may be left unfilled to produce a cigarette filter or the like having a low resistance to draw, a low pressure drop and a low filtration efficiency. The wrapping may be provided with a multiplicity of fine apertures communicating with the pocket to admit ambient air to dilute and cool tobacco smoke passing therethrough in a well known manner.

The "flashless" crimping is achieved according to the invention by an array of crimping wheels disposed around the material to be crimped, the wheels having a novel tooth formation which cooperates with one another during crimping so that respective tooth surfaces of adjacent crimping wheels actually slide across one another, substantially eliminating any gaps between the teeth of adjacent wheels through which the material being crimped could otherwise be squeezed. The teeth of the crimping wheels, for example, may each have a crimping surface which engages and squeezes against the material being crimped and an adjacent sealing surface at an angle to the crimping surface. The adjacent wheels are arranged so that, in operation, as a respective set of teeth come into engagement to form a crimp, the crimping surface of a tooth on one wheel slides across a sealing surface of a tooth on the adjacent wheel to preclude the formulation of "flash".

The number of crimping wheels disposed around the rod material to be crimped is dependent on the shape of crimped section required to be formed. In a preferred form of the invention, for example, four crimping wheels may be used, with their axes at right angles to each other, to produce square-shaped crimped sections or bars with no flashing along their longitudinal edges. In this arrangement, the crimping surfaces of the teeth also are at right angles to the sealing surfaces. In an alternative arrangement, for example, six crimping wheels may be used to form hexagonal-shaped rods, or three crimping wheels may be used to form crimped sections of triangular cross-section.

According to a further feature of the instant inventive concepts a second crimping apparatus may be provided downstream of the crimping apparatus which forms the flashless connecting rod sections on the crimpable material. The second crimping apparatus may, for example, have a pair of diametrically opposed crimping wheels used to form diametrically opposed grooves in alternate bulbous end portions of the rod. Rod elements of this form can be cut into dumbbell-shaped filter elements in which one bulbous end portion is grooved and the opposite bulbous end portion is free of grooves. The grooved end can be positioned adjacent the tobacco rod in a cigarette to provide a low pressure-drop end portion leading into the annular space surrounding the crimped connection portion described above. As is known in the art, a filter of this construction may also be provided with air-dilution perforations and the like in a surrounding wrapping.

Additional features and advantages of the invention will be apparent from the ensuing description and claims read in conjunction with the attached drawings.

BRIEF DESCRIPTION OF THE DRAWINGS

FIG. 13 is a view similar to FIG. 9 showing a portion of a modified rod-member such as seen in FIGS. 11 and 12 secured to a tobacco section to form a filtered cigarette or the like.

DESCRIPTION OF THE PREFERRED EMBODIMENT

Figure 1:
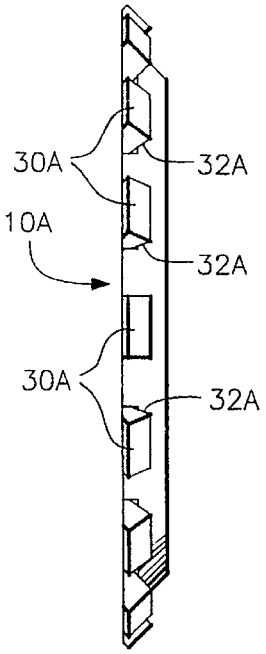
FIG. 1 is a side elevational view of one form of crimping wheel according to the invention.

Like reference characters refer to like parts throughout the several views of the drawings.

The methods and apparatus of this invention may be used to form shaped elements of crimpable material for various uses. Since one use of such elements is as a smoke filter means in cigarettes and the like, the following discussion will be primarily directed toward the production and use of products of this nature. However, nothing therein is intended to limit the scope of the appended claims to tobacco smoke filter means and methods and apparatus for the production of such products.

Figure 2:
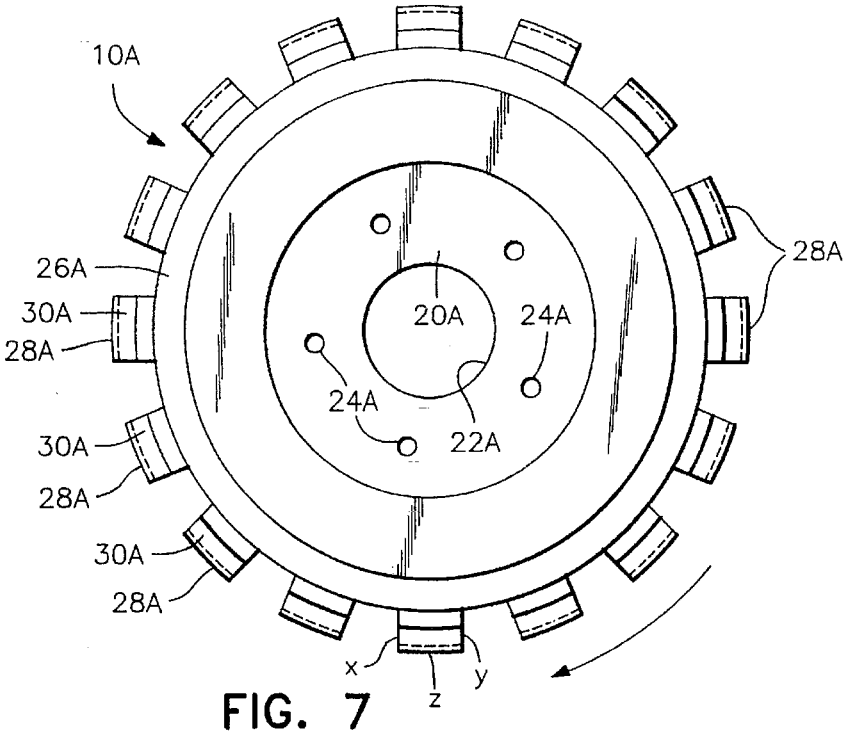
FIG. 2 is a front end elevational view of the wheel of FIG. 1.
Figure 7:
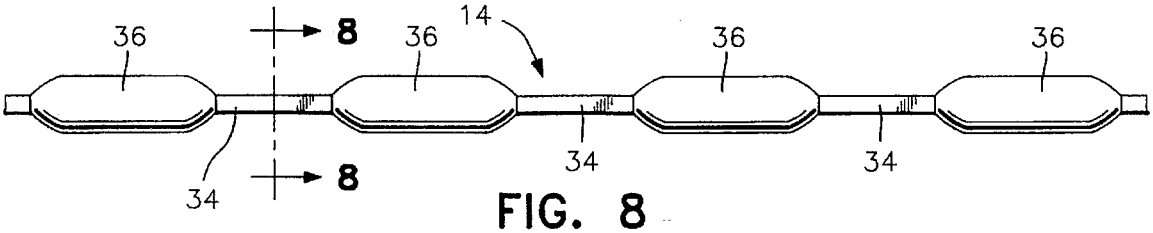
FIG. 7 is a side elevational view of a rod-like member formed by such a crimping apparatus.
Figure 8:
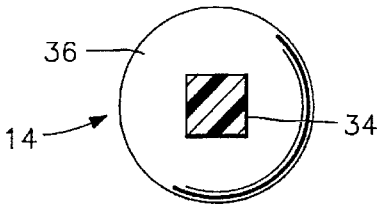
FIG. 8 is an enlarged cross-sectional view taken on line 8—8 of FIG. 7.

In the embodiment illustrated in FIGS. 1–9, four crimping wheels 10A–10D, each of the kind shown in detail in FIGS. 1 and 2, are used in a known form of crimping device, such as described and shown in the aforementioned U.S. patents, to form successive crimps in a travelling rod 12 of crimpable material such as is conventionally formed from a tow of plasticized cellulose acetate fibers or other filter material in the formation of cigarette filter rods and elements. The crimping wheels 10A–10D function schematically in the manner illustrated in FIGS. 3–6 to form the material into a rod-like member 14 (FIGS. 7 and 8) which may then be sub-divided into dumbbell-shaped elements 16 before or after overwrapping in a well-known manner (see FIG. 9).

As noted, the crimpable material 12 engaged by the crimping wheels 10A–10D may, for example, comprise a tow of fibrous tobacco smoke filter material such as plasticized cellulose acetate which has been processed into a rod-like member by any filter making process known in the art. Such process may, for example, include the steps of pulling the tow through a stuffer jet, a steam head and a cooling head to form an air-pervious rod with the fibers bonded to each other at their points of contact. The rod can then be passed to and through a crimping apparatus comprising four crimping wheels with their axes disposed at right angles as seen in the aforementioned U.S. patents, but using the unique crimping wheels 10A–10D of the instant invention in order to produce spaced, substantially "flashless", crimped sections in the travelling material.

The wheels 10A–10D are substantially identical, and accordingly, only wheel 10A will be described in detail with reference to FIGS. 1 and 2. Wheel 10A has a central hub portion 20A with a through-bore 22A and surrounding apertures 24A by which the wheel is mounted on a suitable drive shaft in the crimping apparatus in known manner. An outer ring portion 26A of the wheel is formed with peripheral crimping teeth 28A. Each tooth has an outer crimping surface 30A and an adjacent sealing surface 32A substantially perpendicular to the crimping surface. Like parts of the other wheels 10B–10D are given like reference numerals with the relevant suffix.

Figure 2A:
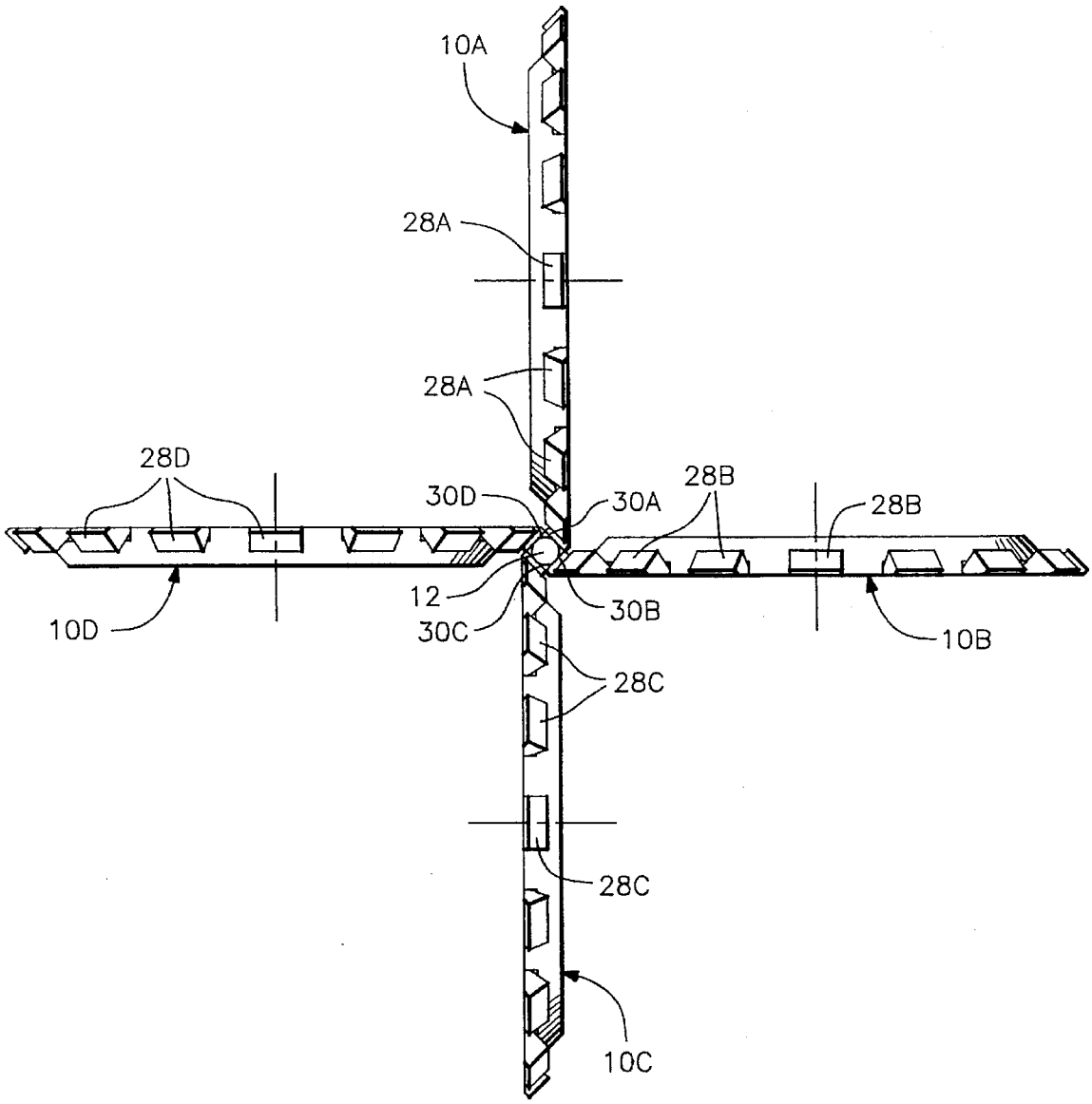
FIG. 2A is a diagrammatic view showing an arrangement of four crimping wheels in a crimping apparatus.

The wheels 10A–10D are arranged in the crimping apparatus, as shown in FIG. 2A, surrounding the travelling crimpable material 12 and with their axes at right angles. In FIG. 2A, the material to be crimped travels in a direction perpendicular to the plane of the drawing between the adjacent edges of the wheels. Looking at FIG. 2, for example, with wheel 10A rotating in the direction of the arrow, the material to be crimped might travel from right to left in the plane of the drawing. As with known crimping apparatus, the wheels are disposed such that, as the wheels rotate, teeth of the respective wheels approach one another and squeeze the tow material therebetween to form a crimped section. As the teeth recede, the material is released.

Accordingly, as the material passes between the rotating wheels, the successive teeth or lobes continuously form spaced crimped sections in the material, alternating with uncrimped sections formed by the space between the teeth. In the present invention, the configuration is such that teeth on the respective wheels actually mesh together and slide across one another while forming a crimped section to eliminate flashing along the mating edges of the wheels, as will be described by reference to FIGS. 3–6 which schematically illustrate the interaction between the teeth of juxtaposed wheels and the material being crimped.

Figure 3:
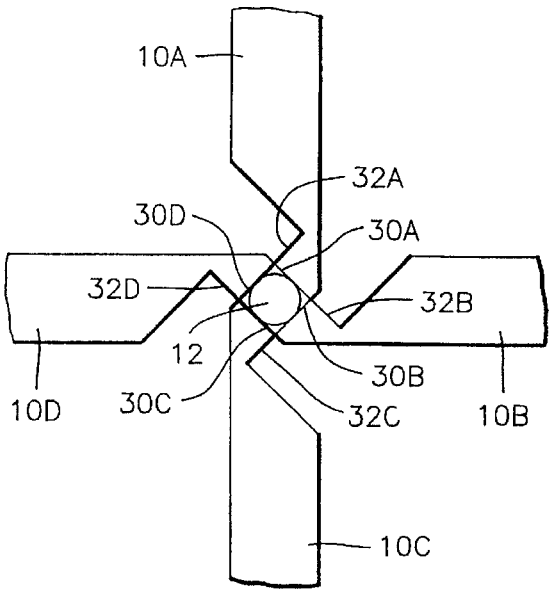
FIGS. 3 through 6 are enlarged schematic views of the crimping wheels showing successive stages of tooth engagement of the wheels during a crimping operation.

FIG. 3 illustrates a position in which the ends of a set of teeth 28A–28D are just coming into engagement to commence a crimp. This represents the engagement, for example, of a leading end "x" of a tooth 28A on wheel 10A (FIG. 2) with corresponding ends of teeth 28B–28D on the other wheels. As seen in FIG. 3, in this position the edges of the various tooth crimping surfaces 30A–30D are just touching and the uncrimped material 12 is passing through the space defined between the crimping surfaces 30A–30D.

Figure 4:
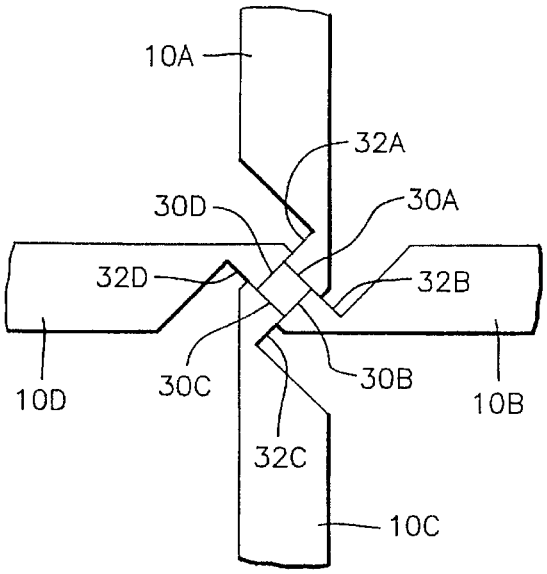
Figure 5:
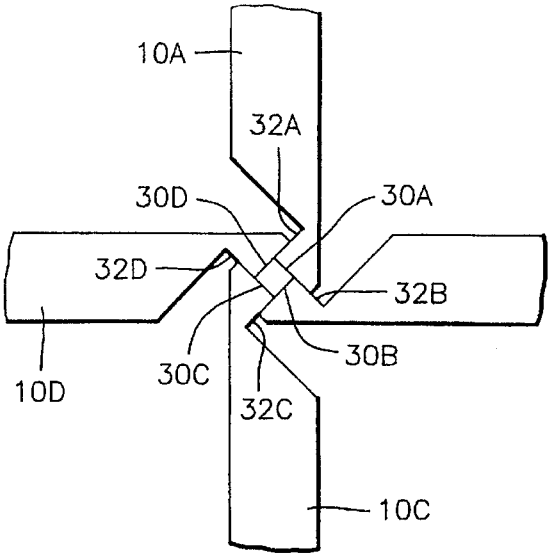

As the wheels continue to rotate, the teeth 28A–28D mesh progressively (FIGS. 4–6) with the crimping surfaces 30A–30D sliding across the sealing surfaces 32A–32D of teeth on adjacent wheels and the tow material 12 being progressively crimped in the decreasing square gap between the teeth. Moreover, the sliding of the crimping surfaces of teeth on one wheel over the sealing surfaces of teeth on a juxtaposed wheel as seen in FIGS. 4–6, prevents the formation of flashing at the corners of the square, i.e., the longitudinal edges of the crimped sections.

Figure 6:
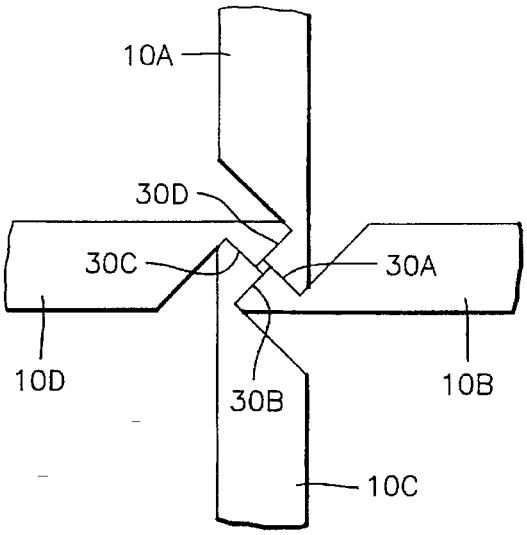

FIG. 6 represents point "z" (FIG. 2) of maximum engagement of the respective teeth. Then, as the wheels continue to rotate, the teeth open out, back to the FIG. 3 position where the trailing end "y" of tooth 28A disengages from the corresponding ends of teeth 28B–28D.

The crimping apparatus thus produces a rod-like member 14 (FIGS. 8 and 9) having thin, square-shaped, crimped sections or bars 34 integrally interconnecting bulbous noncrimped sections 36. The longitudinal edges or corners of the crimped sections are substantially free of flashing.

The drawings are exaggerated for illustrative convenience and not necessarily to scale. In practice, the length of each crimped section 34 corresponds substantially to the length of each tooth 28A–28D between ends x and y and the length of each bulbous section 26 corresponds substantially to the length of the spaces between the teeth on the crimping wheels.

Rod-like member 14 can be sub-divided by cutting the same intermediate the non-crimped sections 36 to form dumbbell-shaped elements 16 which can find utility in the manufacture of cigarettes and related products, such as in the production of filtered cigarettes. In this respect, the rod-like member 14 may be continuously overwrapped in any conventional manner with a paper or the like wrapping material 38 prior to cutting. In doing so, annular pockets 39 may be formed between the wrapping 38 and the crimped sections 34 which may be filled with a smoke-modifying material such as particles of activated charcoal 40 or the like in any well-known manner. The absence of flashing on the corners of the crimped section improves the distribution and uniformity of the granular material, minimizing channelling and enhancing the filtering efficiency.

Figure 9:
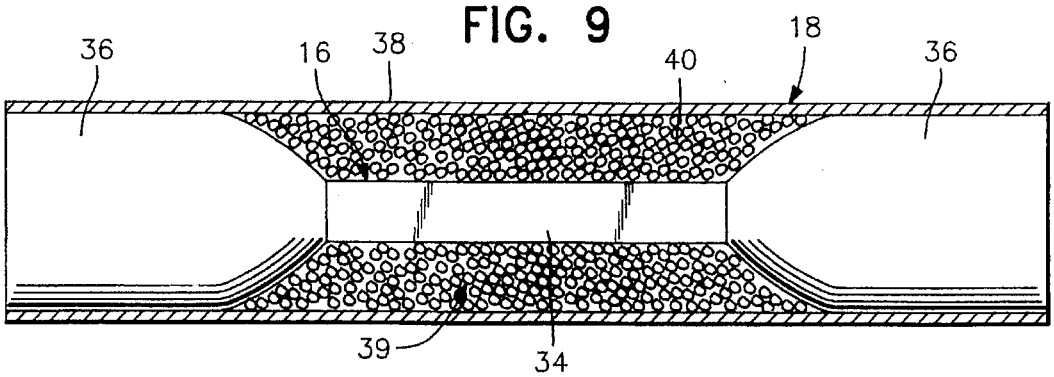
FIG. 9 is a side elevational view of a tobacco smoke filter or the like made from a part of the rod-like member, with portions broken away and in cross-section for illustrative clarity.

As is customary in cigarette manufacturing, pairs of cigarettes may be formed end-to-end with a double filter length element secured intermediate the tobacco sections by a tipping overwrap (not shown in FIG. 9). The filter element may then be cut centrally to form individual cigarettes. Also, the wrapping 38 (and any tipping overwrap) may include air-dilution perforations (not shown) for admitting ambient air to the annular pocket 39. It is advantageous also for the bulbous noncrimped sections 36 of the rod-like member to be made somewhat oversized in diameter to be compressed by the wrapping 38 during manufacture. This procedure enhances the seal between the wrapping 38 and the filter ends 36, avoiding by-passing of smoke along this interface and forcing the smoke through the pervious non-crimped sections 36.

FIGS. 10–13 illustrate a second embodiment of the invention in which alternate bulbous sections 36" of the rod-like member 14' are additionally provided with diametrically opposed lengthwise grooves 42, the rod-like member 14' otherwise being the same as member 14 previously described.

Figure 10:
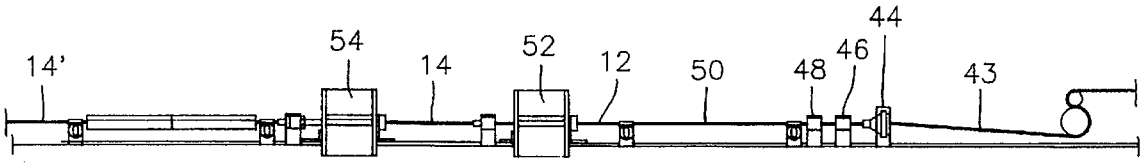
FIG. 10 is a somewhat diagrammatic elevational view of a processing line for making modified rod-like members according to the invention.
Figure 11:
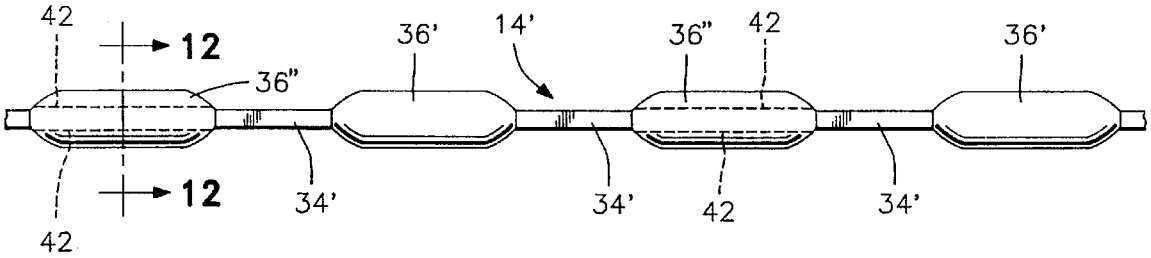
FIG. 11 is a side elevational view of a modified rod-like member.
Figure 12:
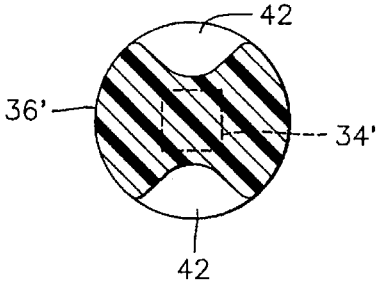
FIG. 12 is an enlarged cross-sectional view taken on line 12—12 of FIG. 11.

Member 14' may, for example be produced in a manufacturing line as shown in FIG. 10 of a type similar to that used to form member 14, but with tandem crimping means according to a feature of the instant inventive concepts. In such a line, a filamentary tow 43 may be drawn through a conventional stuffer jet 44, steam head 46 and cooling head 48 by a pulling device 50. The resultant rod 12 then proceeds through a first crimping apparatus 52 including, for example four crimping wheels as previously described for forming spaced, flashless, crimped sections 34' in the rod 12. Thence, the rod passes through a second crimping apparatus 54 having at least one and perhaps two or more diametrically opposed, crimping wheels (not shown), with conventional teeth or lobes which are configured and synchronized with the rod movement to form longitudinal grooves 42 only in the alternate uncrimped sections 36" of the rod. The rod-like member 14' may be passed from the second crimping apparatus 54 through a further cooling station by a conventional pulling device, wrapped and cut in a conventional manner (not shown).

Figure 13:
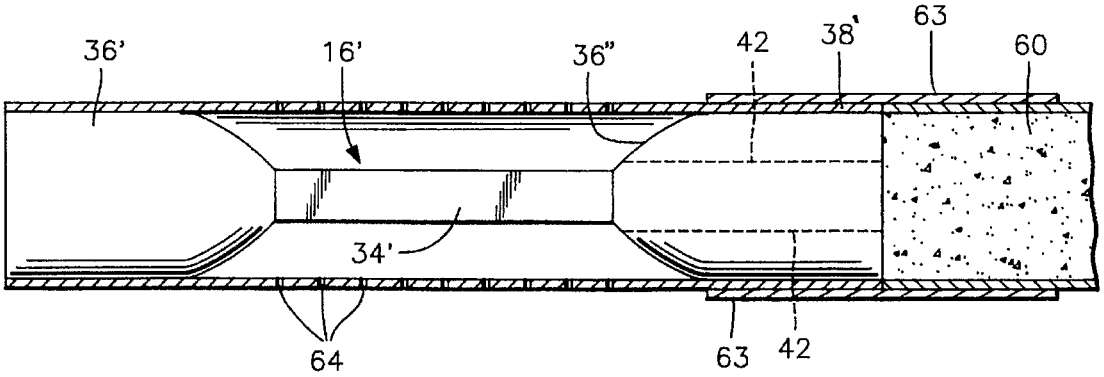

The rod-like member 14' may be used to form cigarette filters of the kind shown in FIG. 13 where a dumbbell-shaped element 16' is secured as by a tipping overwrap (not shown) or band 63 to one end of a tobacco rod 60 with its grooved end 36" adjacent the tobacco. Air-dilution apertures 64 or the like may be provided and the end portions may be somewhat oversized and compressed by the wrapping 38'. In this arrangement, the grooved end 36" of the filter provides a low resistance to passage of smoke, resulting in a low pressure drop and low filtration efficiency in the ultimate product.

While only preferred embodiments of the invention have been described herein in detail, the invention is not limited thereby and modifications can be made within the scope of the appended claims.

We claim:

1. An elongate rod-like member for use in a cigarette or the like, said member comprising a polymeric material and including spaced bulbous sections of relatively large cross-section alternating lengthwise of the member with connecting sections of relatively small cross-section integrally interconnecting said bulbous sections, said bulbous sections each including intercommunicating passageways defining an air-pervious plug, and said connecting sections having elongate edges substantially free of flashing.

2. A rod-like member as claimed in claim 1, wherein said polymeric material comprises a multiplicity of polymeric fibers, and said air-pervious plugs are defined by said fibers being bonded to each other at their contact points.

3. A rod-like member as claimed in claim 2, wherein said polymeric fibers comprise a cellulose acetate tow.

4. A rod-like member as claimed in claim 1, wherein said connecting sections have a polygonal cross-section.

5. A rod-like member as claimed in claim 4, wherein said connecting sections have a square cross-section.

6. A rod-like member as claimed in claim 1, wherein alternate ones of the bulbous sections include at least one longitudinal extending peripheral groove.

7. A rod-like member as claimed in claim 6, wherein said alternate bulbous sections include diametrically opposed longitudinally extending peripheral grooves.

8. A rod-like member as claimed in claim 1, further comprising a substantially tubular overwrap material covering said rod-like member and spanning the space between said bulbous sections to define annular pockets surrounding said connecting sections.

9. A rod-like member as claimed in claim 8, wherein said bulbous sections are radially compressed by said overwrap material.

10. A rod-like member as claimed in claim 8, further comprising a multiplicity of apertures defined in said overwrap material in communication with said pockets.

11. A rod-like member as claimed in claim 8, further comprising a smoke-modifying material contained within said pockets.

12. A rod-like member as claimed in claim 11, wherein said smoke-modifying material comprises activated charcoal particles.

13. An element for use in a cigarette or the like comprising a length of polymeric material having spaced bulbous ends integrally interconnected by a central section of relatively smaller cross-section, said bulbous ends each comprising an air-pervious plug, and said central section having elongate edges extending between said bulbous ends, said edges being substantially free of flashing.

14. An element as claimed in claim 13, wherein said polymeric material comprises a multiplicity of polymeric fibers, and said air-pervious plugs are defined by said fibers being bonded to each other at their contact points.

15. An element as claimed in claim 14, wherein said polymeric fibers comprise a cellulose acetate tow.

16. An element as claimed in claim 13, wherein said central section is polygonally shaped.

17. An element as claimed in claim 16, wherein said central section has a square shape.

18. An element as claimed in claim 13, wherein one of said bulbous ends has at least one longitudinally extending peripheral groove.

19. An element as claimed in claim 18, wherein said one bulbous end has diametrically opposed longitudinally extending peripheral grooves.

20. An element as claimed in claim 18, further comprising a substantially tubular overwrap material covering said element and spanning the space between said bulbous ends to define an annular pocket surrounding said central section.

21. An element as claimed in claim 20, wherein said bulbous ends are radially compressed by said overwrap material.

22. An element as claimed in claim 20, further comprising a multiplicity of apertures defined in said overwrap material in communication with said pocket.

23. A cigarette comprising a tobacco section and at least one element as claimed in claim 22 secured in end-to-end relationship with said tobacco section.

24. A cigarette comprising a tobacco section and at least one element as claimed in claim 20 secured in end-to-end relationship with said tobacco section.

25. A cigarette as claimed in claim 24, wherein said one bulbous end is juxtaposed to said tobacco section.

26. An element as claimed in claim 13, further comprising a substantially tubular overwrap material covering said element and spanning the space between said bulbous ends to define an annular pocket surrounding said central section.

27. An element as claimed in claim 26, wherein said bulbous ends are radially compressed by said overwrap material.

28. An element as claimed in claim 26, further comprising a multiplicity of apertures defined in said overwrap material in communication with said pocket.

29. A cigarette comprising a tobacco section and at least one element as claimed in claim 28 secured in end-to-end relationship with said tobacco section.

30. An element as claimed in claim 26, further comprising a smoke-modifying material contained within said pocket.

31. An element as claimed in claim 30, wherein said smoke-modifying material comprises activated charcoal particles.

32. A cigarette comprising a tobacco section and at least one element as claimed in claim 30 secured in end-to-end relationship with said tobacco section.

33. A cigarette comprising a tobacco section and at least one element as claimed in claim 26 secured in end-to-end relationship with said tobacco section.

34. A tobacco smoke filter having a core element comprising a length of tobacco smoke filter material with smoke-pervious bulbous ends integrally interconnected by a crimped central section of relatively smaller cross-section than said bulbous ends, said central section having elongate edges extending between said bulbous ends, said edges being substantially free of flashing, and a tubular wrapping secured over said bulbous ends of said core element and defining an annular pocket around said central section of said core element.

35. A filter as claimed in claim 34, further including a smoke-modifying material contained within said pocket.

36. A filter as claimed in claim 35, wherein said smoke-modifying material comprises activated charcoal particles.

37. A filter as claimed in claim 34, further including air dilution means in said wrapping.

38. A filter as claimed in claim 34, wherein said ends of the core element are radially compressed by said wrapping.

39. A filter as claimed in claim 34, wherein one of said bulbous ends includes at least one lengthwise extending peripheral groove.

40. Apparatus for forming a rod-like member from a travelling length of crimpable material, the rod-like member having crimped sections of relatively small cross-section alternating lengthwise with non-crimped sections of relatively larger cross-section, said apparatus including a first crimping means for forming said crimped sections, said first crimping means comprising a plurality of crimping wheels disposed around a path along which the material is to travel, each wheel having an axis of rotation in a plane perpendicular to said path, the axes of the respective wheels being angled with respect to each other, each wheel having spaced circumferentially disposed teeth, each tooth having an outwardly facing crimping surface and an adjacent sealing surface angled with respect to said crimping surface, said wheels being located for engagement of corresponding teeth on the respective wheels when the wheels are rotated about said axes to form a crimped section in said material between said crimping surfaces of the respective teeth with each crimping surface sliding over a sealing surface of an adjacent tooth to prevent material being squeezed between the teeth during formation of the crimped section, thereby forming longitudinal edges on the crimped section substantially free of flashing.

41. Apparatus as claimed in claim 40, said first crimping means comprising four crimping wheels disposed about said path with their respective axes perpendicular to one another for forming crimped sections each having a square cross-section with longitudinal edges substantially free of flashing.

42. Apparatus as claimed in claim 41, wherein said sealing surface of each tooth is perpendicular to said crimping surface.

43. Apparatus as claimed in claim 40, including a second crimping means following said first crimping means in the path of travel of the material, said second crimping means including portions forming at least one longitudinal groove in alternate ones of the non-crimped sections of the material.

44. Apparatus for crimping a travelling length of crimpable material comprising a first crimping means positioned in the path of travel of the material for forming crimped sections in the material of relatively small cross-section alternating with non-crimped sections of relatively larger cross-section, and a second crimping means following said first crimping means in the path of travel of the material for forming further crimps in selected ones of the non-crimped sections.

45. Apparatus as claimed in claim 44, wherein said first crimping means comprises a plurality of crimping wheels spaced around the path of travel of the material, said crimping wheels having mutually cooperating teeth with surfaces adapted to mesh and slide across each other for forming the crimped sections with longitudinal edges substantially free of flashing.

46. Apparatus as claimed in claim 44, wherein said second crimping means comprises at least one crimping wheel for forming a lengthwise groove in alternating ones of the non-crimped sections of the material.

47. A crimping device comprising a plurality of crimping wheels each of which has a central axis, each wheel including a plurality of teeth equally spaced around an outer circumference, each tooth having an outwardly facing crimping surface inclined with respect to said axis and a sealing surface at an angle to said crimping surface, each of said wheels being rotatably mounted about its axis with said crimping surface of the teeth of each wheel sliding over a sealing surface of the teeth of a juxtaposed wheel as said wheels are rotated to produce crimped sections in material passing between said crimping surfaces, which crimped sections include longitudinal edges substantially free of flashing.

48. A wheel as claimed in claim 47, wherein said sealing surface of each tooth is disposed at a right angle to said crimping surface.

49. A method of forming a rod-like member from a travelling length of crimpable material which includes the steps of successively forming spaced crimped sections in the material alternating with non-crimped sections by successively squeezing the material between cooperating peripheral teeth of a plurality of crimping wheels spaced around a path along which the material travels and causing crimping surfaces of the teeth on each wheel to engage and slide across sealing surfaces of the teeth on an adjacent wheel while forming each crimped section thereby preventing material being squeezed between the wheels and forming the crimped sections with longitudinal edges substantially free of flashing.

50. A method as claimed in claim 49, including the further steps of wrapping said rod-like member with a tubular wrapping secured around the non-crimped sections, and cutting the wrapped member into discrete lengths substantially centrally of selected non-crimped sections.

51. A method as claimed in claim 50, which includes, prior to the wrapping step, the additional step of forming alternate non-crimped sections each with at least one longitudinally extending peripheral groove in a further crimping operation.

52. A method as claimed in claim 51, which includes the step of securing said lengths of the rod-like member to one end of tobacco rods to form filtered cigarettes with the grooved non-crimped sections thereof adjacent the end of the respective tobacco rod.

53. A method as claimed in claim 50, wherein the wrapping step comprises the step of compressing the non-crimped sections radially by means of the tubular wrapping.

54. A method as claimed in claim 50, which includes the step of adding a smoke-modifying material to the interior of the wrapping in an annular pocket formed between the non-crimped sections and the wrapping.

55. A method as claimed in claim 54, wherein the smoke-modifying material comprises activated carbon particles.

56. A method as claimed in claim 50, which includes the step of securing said lengths of the rod-like member to one of tobacco rods to form filtered cigarettes.

* * * * *